US005217685A

United States Patent [19]

Cook et al.

[11] Patent Number: 5,217,685

[45] Date of Patent: Jun. 8, 1993

[54] ABUTMENT BASE ALLOY FOR JAWBONE MOUNTED DENTAL IMPLANTS

[75] Inventors: Rodger E. Cook, Woodland Hills; Savario A. D'Agostino, Camarillo; Robert A. Lundstrom, Westlake Village; Charles W. Westrick, Moorpark, all of Calif.

[73] Assignee: The Wilkinson Company, Westlake Village, Calif.

[21] Appl. No.: 770,640

[22] Filed: Oct. 3, 1991

[51] Int. Cl.[5] ..... C22C 5/02

[52] U.S. Cl. ..... 420/509; 433/200.1; 428/458

[58] Field of Search ..... 420/509; 148/405, 430; 433/173, 174, 202.1; 428/458

[56] References Cited

U.S. PATENT DOCUMENTS

| | | | |
|---|---|---|---|
| 1,169,753 | 1/1916 | Peschko | 420/509 |
| 1,987,452 | 1/1935 | Taylor | 420/509 |
| 2,050,040 | 8/1936 | Coleman et al. | 420/509 |
| 2,304,416 | 12/1942 | Leuser | 420/509 |
| 3,340,050 | 9/1967 | Nielsen et al. | 420/509 |
| 3,413,723 | 12/1968 | Wagner et al. | 420/509 |
| 3,961,420 | 6/1976 | Tuccillo | 420/508 |
| 3,981,723 | 9/1976 | Tuccillo | 420/508 |
| 4,007,040 | 2/1977 | Kropp | 420/509 |
| 4,008,080 | 2/1977 | Wagner | 420/508 |
| 4,014,690 | 3/1977 | Dudek et al. | 420/509 |
| 4,522,783 | 6/1985 | Menicucci | 420/509 |
| 4,591,483 | 5/1986 | Nawaz | 420/508 |
| 4,960,381 | 10/1990 | Niznick | 433/174 |
| 4,988,298 | 1/1991 | Lazzara et al. | 433/173 |

FOREIGN PATENT DOCUMENTS

| | | |
|---|---|---|
| 346595 | 12/1989 | European Pat. Off. . |
| 53-018423 | 2/1978 | Japan . |

*Primary Examiner*—John P. Sheehan
*Assistant Examiner*—Margery S. Phipps
*Attorney, Agent, or Firm*—Kelly Bauersfeld & Lowry

[57] ABSTRACT

A hard, zinc-free gold alloy for an abutment base used with jawbone mounted dental implants is prepared containing approximately by weight 64 percent gold, 22 percent palladium, 9 percent silver, 4.5 percent platinum, and 0.5 percent iridium.

4 Claims, 1 Drawing Sheet

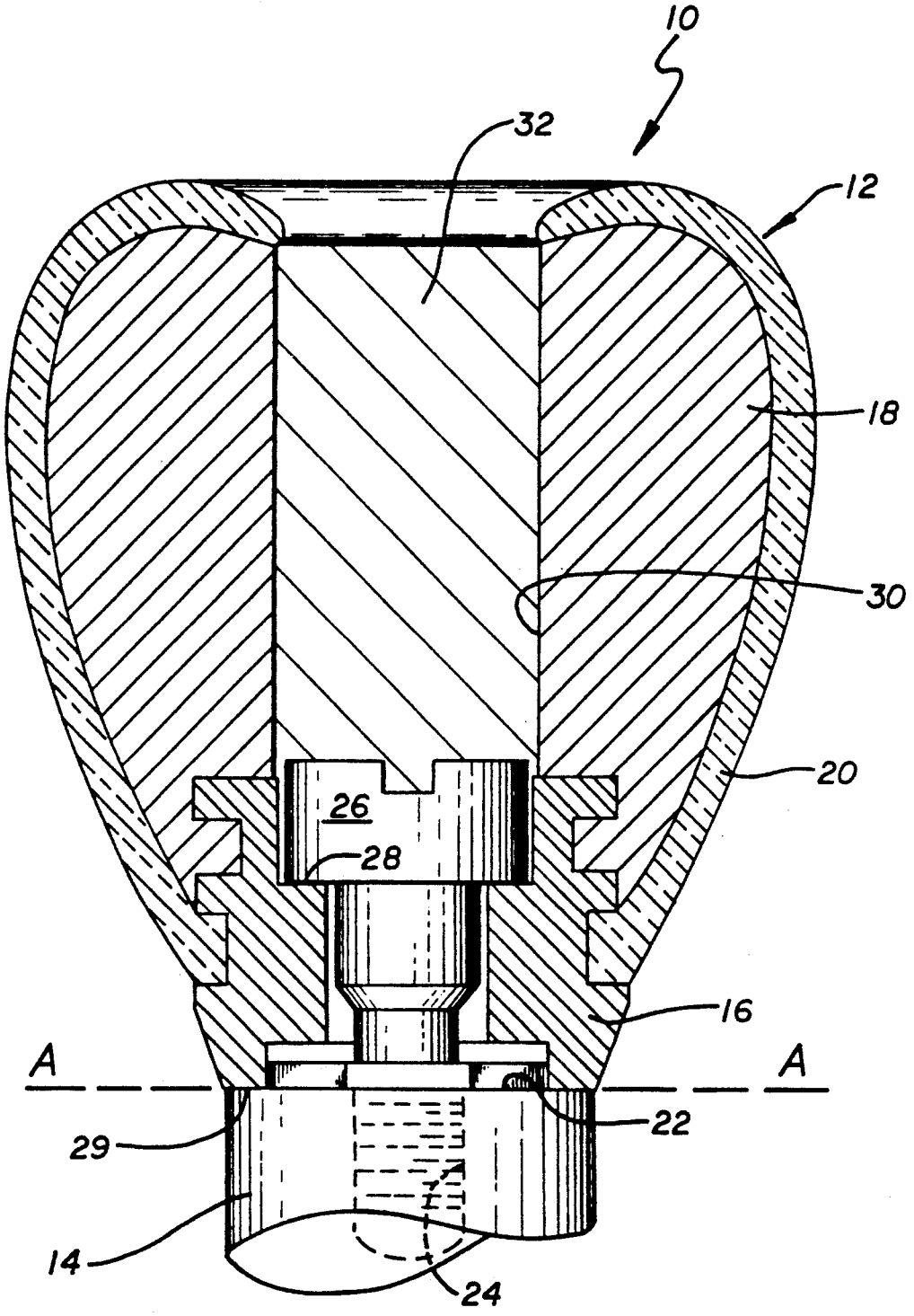
10
32
12
18
30
20
26
28
16
A
A
22
29
14
24

ABUTMENT BASE ALLOY FOR JAWBONE MOUNTED DENTAL IMPLANTS

FIELD OF THE INVENTION

The present invention relates generally to restorative dentistry. More specifically, this invention relates to an alloy for an abutment base used with jawbone anchored dental implants.

BACKGROUND OF THE INVENTION

Restorative dentistry has made significant advances in the use of dental implants to support dental restorations intended to permanently replace natural teeth. Single-tooth restorations are possible using dental implants. Dental implants provide an alternative to removable dentures and eliminate the problems associated therewith such as poor fit, unsightliness, etc.

A dental implant restoration utilizes a jawbone mounted fixture adapted to be directly implanted in the alveolar ridge crest of a patient's edentulous jawbone after the gum tissue has been displaced. A coronal end of the fixture has at its gingival aspect a transverse surface that is flush or nearly flush with the alveolar ridge crest of the jawbone after the fixture has been implanted in it. The fixture is typically made from a biocompatible implant material such as titanium or a titanium alloy.

As described, for example, in U.S. Pat. No. 4,988,298 to Lazzara et al. and incorporated by reference herein, the dental implant restoration includes an abutment base used to accurately fix a permanent dental restoration (prosthesis) on the implant fixture. In this regard, the abutment base comprises a precision formed component adapted for securely carrying the prosthesis, while defining a precision formed abutment surface for seating against the gingival aspect of the fixture to orient the prosthesis in a predetermined and accurate manner within the patient's mouth. The prosthesis includes a supragingival substructure having a gingival end shaped for mating with the abutment base, in combination with an anatomical overlay which envelops the abutment base at its gingival end. Porcelain is most commonly used as the overlay material for aesthetic reasons.

In accordance with conventional procedures, the abutment base is first cast and then precision machined to include the abutment surface for precision fit with a gingival aspect transverse surface of the implanted fixture. The substructure of the prosthesis is then cast onto the abutment base, preferably at brazing temperatures, and the porcelain overlay is then formed, as by baking. The thus assembled dental restoration, with the abutment base fixed at the gingival end of the prosthesis substructure and overlay, is fastened to the implanted fixture with a screw or bolt. The screw is normally mounted within a central vertical bore formed in the prosthesis and is fastened into a threaded socket in the implanted fixture to clamp the abutment base tightly against the fixture. After screw installation, the central bore can be filled with a suitable dental amalgam which can be drilled out later if and when access to the screw is required to remove the restoration from the implanted fixture.

In the past, the abutment base for a jawbone anchored restoration has been constructed from a dental alloy such as a gold-based alloy of the general type described in the literature and intended for use in making crowns, etc. Such alloys, however, have not optimally met the unique requirements for an abutment base which desirably possesses a number of specific physical properties. That is, customary gold dental alloys though somewhat malleable even when hardened in order to accommodate chewing forces, are still harder (typically Vickers 300) than the abutment base alloy of the present invention in order to have good wear resistance. By contrast, the abutment base alloy desirably possesses sufficient ductility or malleability and tensile strength to accommodate the high stress and torque encountered at the connection site between a jawbone implant fixture and the dental prosthesis and prevent catastrophic brittle failures. Moreover, the abutment base alloy desirably has a high degree of machineability so that angular deviations in implant fixture position can be precision adjusted by shaping of the abutment base.

It has been known that the strength (tensile strength) of dental alloys can be increased with a high silver or silver-zinc content, but such approaches are not compatible with porcelain overlays due to discoloration (greening) thereof. Since the overlay in a jawbone anchored restoration is typically made of porcelain, and directly contacts the abutment base, a rigidified abutment base alloy with a high silver content or containing zinc would be aesthetically unacceptable. See, for example, Kropp, U.S. Pat. No. 4,007,040. Not only must the dental alloy be compatible with porcelain, it must be compatible with the dental implant fixture material, typically titanium or a titanium alloy.

It has also been known that strength can be attained in a dental alloy by additions of metals of the platinum group, such as platinum or palladium. A small amount of iridium in the alloys is also known to produce a fine grain structure. In recent years, because of the high price of gold and platinum, alloys have been employed in which part of the gold and platinum content is replaced by palladium. However, the gold and platinum content has remained relatively high in order not to sacrifice casting properties.

Accordingly, there exists a need for an improved dental alloy with a novel combination of physical properties which makes it useful in the casting of abutment bases. Specifically, there is a need for an abutment base alloy which is easily precision machined to adjust for deviations in positioning of a jawbone implanted fixture, which has high structural strength and ductility (toughness) to withstand the extreme stresses of an abutment base, which is compatible with the prosthesis overlay and fixture material, and which is relatively economical in comparison with known dental alloys. The present invention fulfills these needs and provides further related advantages.

SUMMARY OF THE INVENTION

According to the present invention and exemplary embodiment described herein, an alloy for an abutment base used with jawbone anchored dental implants is provided. The abutment base alloy is compatible with the oral environment and with implant materials. The alloy is designed for easy precision machining, has high structural strength and ductility to withstand the peculiar stresses on a dental implant and is relatively less expensive than known dental alloys by the substitution of less expensive metals without sacrificing the necessary physical properties.

The objectives of this invention have been achieved in alloys containing approximately by weight 59–69 % gold, 17–27% palladium, 4–13% silver, 1–8% platinum and 0.25 to 3.0% iridium. Preferably, alloys with about 64 weight % gold contain about 22 weight % palladium, 9 weight % silver, 4.5 weight % platinum and 0.5 weight % iridium.

Other features and advantages of the invention will become apparent from the following more detailed description, taken in conjunction with the accompanying drawing which illustrates, by way of example, the principles of the invention.

BRIEF DESCRIPTION OF THE DRAWING

The accompanying drawing illustrates an exemplary jawbone anchored dental implant having an abutment base formed from the alloy of the present invention.

DETAILED DESCRIPTION OF THE PREFERRED EMBODIMENT

As shown in the exemplary drawing, a dental restoration generally designated by the reference number 10 is shown including a dental prosthesis 12 adapted for secure and precise attachment to a dental implant fixture 14 by means of an abutment base 16. The abutment base 16 is formed from the improved alloy of the present invention for supporting the prosthesis 12 in a secure and stable manner, and at a precise orientation within the patient's mouth.

In a jawbone anchored dental restoration, as described generally in U.S. Pat. No. 4,988,298, the fixture 14 of known design is surgically implanted into a patient's jawbone (not shown), the gingival surface of which is indicated by the dashed line A—A in the drawing figure. The coronal aspect of the implanted fixture defines a transversely extending gingival surface 22 which is normally flush or nearly flush with the gingival surface A—A of the person's jawbone. An internally-threaded socket 24 extends axially into the fixture 14.

The abutment base 16 is securely attached to the lower or gingival end of the prosthesis 12 and functions to provide a rigid interconnection between the jawbone anchored fixture 14 and the prosthesis 12. The illustrative prosthesis includes a substructure 18 of a suitable dental alloy such as a traditional alloy of the type used for dental crowns and the like, wherein the substructure is typically formed by casting in interlocked relation with the abutment base 16. The substructure 18 in turn supports an anatomical overlay 20 of a suitable ceramic or ceramic-based material, such as porcelain, which covers the gingival end of the substructure 18 and envelops the abutment base 16 for interlock therewith.

The abutment base 16 is fixed to the implant fixture 14 with a screw or bolt 26 fastened into the socket 24. A head of the screw 26 clamps against a shoulder 28 on the abutment base to force a precision formed abutment surface 29 into seated contact with the gingival surface 22 of the implanted fixture. Access to the screw 26 is via a central hole 30 in the prosthesis 12 which may be filled with a suitable amalgam plug 32 that can be drilled out later if and when access to the screw should be required to remove the prosthesis 12 from the implanted fixture 14.

The relative proportions of the various elements comprising the novel alloy of the invention have been determined as a result of investigation to obtain an alloy possessing substantially optimum physical properties for an abutment base alloy. Specifically, it has been found that the abutment base alloy of the invention should contain by weight approximately gold 59–69%, palladium 17–27%, silver 4–13%, platinum 1–8% and iridium 0.25–3%. A preferred alloy contains by weight about 64% gold, 22% palladium, 9% silver, 4.5% platinum and 0.5% iridium.

In the following table there are set forth the measured mechanical values of the preferred inventive alloy:

| | Ultimate Tensile Strength | % Elongation | Hardness |
|---|---|---|---|
| Annealed Condition | 60.2 kpsi | 40.5% in 2 inches | 70 Vickers |
| As Drawn Condition | 80.4 kpsi | 15.9% in 2 inches | 126 Vickers |
| Stress Relief Anneal | 85.2 kpsi | 26.0% in 2 inches | 128 Vickers |

The value for % elongation represents the ductility or malleability of the inventive alloy. The abutment base alloy is matched with an implant fixture made from pure titanium or a titanium alloy having a comparable strength and ductility. For example, an implant fixture made from commercially pure titanium or a titanium alby having a tensile strength of 55 kpsi and 45% elongation would be matched with the inventive alloy in the annealed condition. By the same token, the inventive alloy in the stress relief anneal condition would be matched with an implant fixture material having a tensile strength of 90 kpsi and 25% elongation as the tensile strength and % elongation of the abutment base alloy in the stress relief annealed condition and the implant fixture material are comparable. As between the stress relief anneal and as drawn conditions, the stress relief anneal condition is preferred because of the higher tensile strength and ductility.

By contrast to the abutment base alloy, customary gold dental alloys have tensile strength values of about 85–110 kpsi and % elongation of about 9% after casting.

In addition, since the machined abutment base is threaded into the implant fixture, it is advantageous to have a mismatch in hardness between the abutment base alloy and the implant fixture material. The titanium or titanium alloy implants have hardnesses ranging from Vickers 220 and 266 and the abutment alloy ranges from 70 to 128 Vickers. This minimizes friction and galling thus assuring a reliable mating of prosthesis to the implant fixture.

The alloy of this invention can be cast to the approximate desired shape and then machined with excellent precision due to its relative structural ductility. The resultant abutment base can thus be precision and custom fitted to the dental implant fixture to assure accurate orientation of the prosthesis in the patient's mouth. In use, the alloy possesses the strength and ductility (toughness) necessary for use as an abutment base in a jawbone anchored dental implant, providing a strong and durable joint at the interface between the overlying prosthesis and the underlying fixture, wherein the structure is capable of withstanding the high torque and other stresses encountered during normal patient function. The use of palladium in the alloy of the invention, in the proportion used, substantially reduces the cost in comparison with known dental alloys without sacrifice of physical properties.

Although a particular embodiment of the invention has been described in detail, various modifications may be made without departing from the spirit and scope of the invention. Accordingly, the invention is not to be limited except as by the appended claims.

What is claimed is:

1. For use in a jawbone mounted dental implant having a fixture implanted within the jawbone of a patient, and a dental prosthesis supported on an abutment base, an improved abutment base alloy comprising, by percent weight:

about 64 percent gold;
about 22 percent palladium;
about 9 percent silver;
about 4.5 percent platinum; and
about 0.5 percent iridium.

2. The abutment base alloy of claim 1 wherein said alloy is zinc-free.

3. For use in a jawbone mounted dental implant having a fixture implanted within the jawbone of a patient, and a dental prosthesis supported on an abutment base, an improved abutment base alloy consisting essentially of, by percent weight:

about 64 percent gold;
about 22 percent palladium;
about 9 percent silver;
about 4.5 percent platinum; and
about 0.5 percent iridium.

4. The abutment base alloy claim 3 wherein said alloy is zinc-free.

* * * * *